United States Patent [19]

Sweeney

[11] 4,378,973

[45] Apr. 5, 1983

[54] DIESEL FUEL CONTAINING CYCLOHEXANE, AND OXYGENATED COMPOUNDS

[75] Inventor: William M. Sweeney, Wappingers Falls, N.Y.

[73] Assignee: Texaco Inc., White Plains, N.Y.

[21] Appl. No.: 337,563

[22] Filed: Jan. 7, 1982

[51] Int. Cl.[3] ..... C10L 1/18

[52] U.S. Cl. ..... 44/56; 44/57; 585/14

[58] Field of Search ..... 44/56, 57; 585/14

[56] References Cited

U.S. PATENT DOCUMENTS

| | | | |
|---|---|---|---|
| 2,065,588 | 12/1936 | Howes | 44/57 |
| 2,143,870 | 1/1939 | Ellis | 44/57 |
| 2,218,135 | 10/1940 | Moser | 44/57 |
| 2,221,839 | 11/1940 | Lipkin | 44/57 |
| 3,515,526 | 6/1970 | Cherry | 585/14 |

*Primary Examiner*—Charles F. Warren
*Assistant Examiner*—Y. Harris Smith
*Attorney, Agent, or Firm*—Carl G. Ries; Robert A. Kulason; Henry W. Archer

[57] ABSTRACT

The amount of smoke, soot and invisible particulates emitted with the exhaust of engines run on diesel fuel is reduced by incorporating therein an additive consisting of a synergistic mixture of cyclohexane with an oxygenated compound which readily gives up oxygen during combustion.

Also disclosed is a method of operating a diesel engine using the fuel of the invention.

7 Claims, No Drawings

DIESEL FUEL CONTAINING CYCLOHEXANE, AND OXYGENATED COMPOUNDS

BACKGROUND OF THE INVENTION

1. Field of the Invention

This invention relates to means and a process for reducing exhaust emissions of diesel fuels. More particularly, the invention is concerned with reducing the amount of invisible particulates in diesel engines exhaust emissions. The invention also relates to a method for operating a diesel engine in such a manner that there is produced a minimum of harmful obnoxious exhaust smoke by that engine.

Diesel fuels used in diesel engines give off in the exhaust of the engine particulates which recent tests indicate to be harmful pollutants. These particulates include not only those that exist as visible smoke when the diesel engine is overloaded or when the engine is worn or dirty, but also those that are invisible and emerge from partly loaded clean diesel engines. The Federal Environmental Protection Agency has determined that diesel-powered automobiles emit unacceptably high levels of air pollution and must be reduced to ward off a possible health hazard.

Tests of 10 foreign and domestic cars showed many of the vehicles emitted particulate matter in amounts exceeding the agency's proposed standard for diesel-powered autos.

The proposed standards would allow six-tenths of a gram per mile for 1981 model cars, to be reduced to two-tenths of a gram per mile by the 1985 model year.

2. Description of the Prior Art

The prior art to which this invention relates is aware of coassigned U.S. Pat. Nos. 4,207,078 and 4,222,746.

The first of these describes and claims a diesel engine fuel containing a particulate-suppressing mixture of an alkyl cyclopentadienyl manganese tricarbonyl and an oxygenated compound such as an aldehyde or a ketone. The second patent discloses and claims a diesel fuel containing a particulate-suppressing mixture of a wax oxidate and a fuel soluble organometallic compound.

According to a paper entitled "Diesel Engine Exhaust Emissions and Effect of Additives" by M. S. El Nesa et al., *Instr. Mech. Engs.* C137/71, pages 156–162, the addition of small percentages of cyclohexane to 40–50 cetane diesel fuels reduces smoke level, CO, formaldehyde and oxides of nitrogen occurring in the exhaust of a diesel engine.

OBJECTS AND SUMMARY OF THE INVENTION

The main object of this invention is to provide diesel fuel compositions which emit, during use, reduced amounts of particulate combustion products and smoke.

Other objects and advantages of the invention will be apparent from the following description and the accompanying claims.

The present invention provides a hydrocarbon base diesel fuel composition containing a minor, particulate-reducing amount of an additive consisting of a mixture of cyclohexane and an oxygenated compound which readily gives up oxygen during diesel engine combustion conditions. The method of the invention comprises supplying to and burning this fuel in a diesel engine.

In accordance with this invention there is blended with the diesel fuel from 0.5 to 5.0 weight percent of cyclohexane; 0.5 to 5.0 weight percent of the oxygenated compound.

Whenever the expression "diesel fuel" is employed in the following description and claims, it is to be understood that it designates that hydrocarbon fraction which distills after gasoline. Its property requirements are those given on page 11–37 of the "Petroleum Processing Handbook", 1967 Edition. Generally, the diesel fuel will comprise a mixture of hydrocarbons boiling within the range of from 320° to 700° F.

DISCLOSURE OF THE INVENTION

In accordance with the invention, the diesel fuel is modified by mixing therewith cyclohexane and at least one oxygenated organic compound selected from one of the following groups: aldehydes and ketones having from 3 to 16 carbon atoms such as acetone, isobutyl heptyl ketone, propionaldehyde, ethers and cycloethers containing from 2 to 16 carbon atoms such as tetrahydrofuran, 1,2-butylene oxide and dimethyl ether, alcohols containing from 2 to 26 carbon atoms such as ethanol, 2-ethylhexanol and Epal 1012 a trade name for a mixture of normal primary alcohols with carbon atoms ranging from 6 to 20. Mixtures of the aforementioned compounds also can be used.

In general enough of the compounds or mixtures thereof should be added to the diesel fuel to provide from 0.0001 to 1.5 weight percent of oxygen in the combined form.

In the following examples, cyclohexane and the various additives, blended using conventional blending means, give the results shown as indicated below.

PARTICULATES, % REDUCTION AT 55 MPH ROAD LOAD COMPARED TO BASE DIESEL FUEL

| | % Additive in Fuel | | |
|---|---|---|---|
| Example | 1 | 2 | 3 |
| A. Cyclohexane | 5 | 10 | 15 |
| B. Isobutyl Heptyl Ketone | 15 | 17 | 19 |
| C. 50/50 Mix of A & B | 25 | 30 | 40 |
| D. Epal 1012 (Mixture of $C_6$–$C_{20}$ alcohols) | 7 | 9 | 15 |
| E. 50/50 Mix of A & D | 15 | 22 | 34 |
| F. Tetrahydrofuran | 8 | 7 | 14 |
| G. 50/50 Mix of A & F | 16 | 21 | 32 |
| H. 1,2 butylene oxide | — | 6.2 | — |
| I. 50/50 Mix of A & H | — | 11.2 | — |

It should be noted that at all the levels tested, the mixtures of cyclohexane and the additive give greater reduction than either alone and that the results were not merely additive.

The effectiveness of the fuel in suppressing particulates and of the method of the invention are determined by burning untreated fuel and treated fuel in automotive diesel engines and running the exhaust into a dilution tube equipped with a Millipore filter which was weighed before and after combustion. Tests are run at 55 mph road load in a 350N Oldsmobile diesel engine. grade. The effect on particulate production of advanced, standard and retarded injection timing is noted.

The exact mechanism whereby the present additives operate is not known with certainty. However, it is postulated that in a diesel engine combustion, the hydrogen of the fuel molecule is consumed first and if an oxygen deficiency exists in the system complete conversion of the carbon will not occur with resultant particulate formation. This might not seem likely because a diesel is an excess air engine. However, it is possible that due to injection/mixing/fuel characteristics there may not be sufficient oxygen available on a localized basis in intimate contact with the fuel molecules to allow complete combustion within the time frame available. Accordingly, the addition to the fuel of the present oxygenated additives which readily give up oxygen during combustion is beneficial in suppressing particulate and smoke emissions.

Additionally, the cyclohexane is volatile and hydrogen rich. This tends to reduce combustion delays and ensure early and steady fuel burning during fuel injection.

As the oxygenated compounds burns cleaner than the hydrocarbon fuel, the particulates resulting from their combustion would therefore be smaller and more polar than the particulates resulting from the combustion of the hydrocarbon fuel. The attachment of a polar particulate to a hydrocarbon particulate is believed to yield a particulate only slightly larger than the initially formed hydrocarbon particulate but polar in nature. Such particulates, now polar in nature, tend to resist conglomeration with larger particles which would be slower to combust in the oxygen-rich exhaust. The end result is a down sizing of the average particulate size.

The combination of early and steady combustion provided by the hexane and the polarization of the particulates caused by the oxygen rich materials act in a synergistic manner to give a reduction in particulates greater than expected.

While there have been described herein what are at present considered preferred embodiments of the invention, it will be obvious to those skilled in the art that minor modifications and changes may be made without departing from the essence of the invention. It is therefore to be understood that the exemplary embodiments are illustrative and not restrictive to the invention, the scope of which is defined in the appended claims and that all modifications that come within the meaning and ranges of equivalency of the claims are intended to be included therein.

What is claimed is:

1. A diesel fuel composition comprising a mixture of hydrocarbons boiling in the range of 320° to 700° F. and a particulate-suppressing amount of a mixture of cyclohexane with at least one oxygenated compound selected from the group of aldehydes and ketones having from 3 to 16 carbon; normal alcohols having from 2 to 26 carbon atoms in the chain; ethers or cyclic ethers having from 2 to 16 carbon atoms and mixtures thereof; said compound being present in an amount sufficient to provide from 0.0001 to 1.5 weight percent of oxygen to said fuel.

2. The fuel of claim 1, containing from 0.5 to 5.0 weight percent of cyclohexane, and 0.5 to 5.0 weight percent of said oxygenated compound.

3. The fuel of claim 1, wherein said compound is isobutyl heptyl ketone or acetone.

4. The fuel of claim 1, wherein said compound is tetrahydrofuran, 1,2-butylene oxide or dimethyl ether.

5. The fuel of claim 1, wherein said compound is propionaldehyde.

6. The fuel of claim 1, wherein said compound is ethanol, 2-ethylhexanol or a mixture of normal primary alcohols containing from 6 to 20 carbon atoms.

7. A method for reducing the exhaust particulate in the smoke of a diesel engine and the amount of smoke emitted thereby which comprises supplying to and burning in said engine a composition as defined in claim 1.

* * * * *